United States Patent [19]

Byrne

[11] Patent Number: 4,567,779

[45] Date of Patent: Feb. 4, 1986

[54] METHOD AND APPARATUS FOR TORQUE MONITORING

[75] Inventor: Paul Byrne, Plano, Tex.

[73] Assignee: Analog Data Systems, Inc., Dallas, Tex.

[21] Appl. No.: 595,391

[22] Filed: Mar. 30, 1984

[51] Int. Cl.[4] ..... B25B 23/14; G01L 5/24

[52] U.S. Cl. ..... 73/862.25; 173/12

[58] Field of Search ..... 73/862.25; 173/12, 20; 81/467, 469, 470, 472

[56] References Cited

U.S. PATENT DOCUMENTS

| | | | |
|---|---|---|---|
| 1,734,482 | 11/1929 | Greve | 173/20 X |
| 2,527,456 | 10/1950 | Schmeling | 73/862.25 |
| 3,606,664 | 9/1971 | Weiner | 73/862.25 X |
| 4,444,273 | 4/1984 | Ruby | 73/862.25 X |

*Primary Examiner*—Charles A. Ruehl

*Attorney, Agent, or Firm*—Jerry W. Mills; Gregory M. Howison

[57] ABSTRACT

A torque monitoring apparatus includes a Make-Up Tong (10) and a Break-Out Tong (12). The Make-Up Tong (10) is connected to one side of a threaded connection and the Break-Out Tong (12) is connected to the other side of the connection. A chain (22) attached to a winch (24) is operable to activate the Make-Up Tong (10) to torque the connection. A snub line (28) attached to the distal end of the Break-Out Tong (12) restrains movement thereof. A load cell (30) disposed in series with the snub line (28) measures the restraining force thereof. The angular position between the snub line (28) and the Break-Out Tong (12) is maintained constant such that the moment arm utilized for a torque calculation is constant. Therefore, the linear force is directly proportional to the torque and adjustment for angular deviations is not required.

3 Claims, 3 Drawing Figures

METHOD AND APPARATUS FOR TORQUE MONITORING

TECHNICAL FIELD

The present invention pertains in general to apparatus for monitoring torque and, more particularly, to an apparatus for monitoring torque on the connection between two drill sections.

BACKGROUND OF THE INVENTION

During interconnection of two sections of pipe on a drill string, it is necessary that the correct torque be maintained for the interconnection. If this interconnection is not effected properly, failure of the drill string may result. For example, if the two sections of pipe are torqued to a value that exceeds the manufacturers specifications, it is possible that any or all of the following conditions can occur:

SWELLED BOXES
GALLED THREADS
STRIPPED THREADS
STRESS CRACK IN PIN OR BOX

If the torque is at value that is lower than that specified by the manufacturer, it is possible that a proper seal will not be provided. This seal is necessary since pressurized drilling fluids flow through the drill string and could possibly flow around the interconnection and through the side of the drill string if the seal is not present. This may result in a "wash out" of the pipe dope used on the threads when the joint is first made up. If this pipe dope is removed, the action of drilling can cause an overtorque condition resulting in the above conditions. It can also cause the threads to seize together making the breaking of the joint impossible.

During the torquing operation, a Tong is placed around the interconnection after the interconnection is hand tightened. The Tong is essentially a moment arm that is disposed at right angles to the rotational axis of the connection. By disposing a force at right angles to the Tong at a predetermined distance from the connection, a rotational force, or torque, will result at the connection utilizing the Tong as the moment arm. The torque is a combination of the force applied to the Tong and the length thereof which is measured in foot-pounds (ft-lbs). A cable attached to a pneumatically controlled winch is attached to the Tong to provide a manually controlled pulling force. The operator is referred to as a "driller" and he is primarily responsible for the torquing operation. In present systems, a gauge is attached between the cable and the Tong to provide a measurement of pulling force on the face thereof. However, these gauges are susceptible to high inaccuracies and lack the ability to average the torque out over a period of time as they measure the instantaneous torque that is applied. In addition, it is necessary to maintain a 90° angle between the cable attached to the winch and the Tong such that the gauge reading can be directly correlated with torque. If the angle is not maintained perpendicular, inaccuracies may result. Because of this, the driller must pay very close attention to the gauge while also paying attention to his machinery and the people assisting him in the torquing operation. This presents serious disadvantages in that there are many potential hazards that the driller must be aware of.

During the torquing operation, the driller regulates the flow of pressurized air to an air clutch that is attached to the winch to provide the requisite pulling force. This allows the driller to both regulate the rate at which the torque is applied and also the maximum force that is applied to the Tong. In placing the Tong about the interconnection, the driller anticipates the amount of rotation such that the Tong will coincide with the moment arm when the proper torque is reached. However, this is at best a "hit and miss" operation. Depending upon the conditions of the threads, more or less rotation may be required in order to achieve a desired torque reading. Since the only indication of torque that the driller has is the gauge reading which is only an indication of the liner force on the cable, angular deviations between the cable and the Tong are no way accounted for and, as such, may result in damage to the joint.

In view of the above disadvantages with present torque monitoring systems, there exists a need for a torque monitoring apparatus that decreases the probability of overtorquing and undertorquing due to the angular deviations between the cable and the Tong.

SUMMARY OF THE INVENTION

The present invention disclosed and claimed herein comprises an apparatus for torquing a threaded connection between first and second drill sections that includes a Make-Up Tong attached to the first drill section perpendicular to the longitudinal axis thereof. A winch is provided with a cable attached thereto for applying a force to the distal end of the Make-Up Tong to impart a rotational force to the first drill section. A longitudinal member is attached to the second drill section perpendicular to the longitudinal axis thereof. A restraining cord is provided that has one end thereof attached to the distal end of the longitudinal member and the other end thereof attached to an external anchor point. The restraining cord prevents movement of the longitudinal member such that rotation of the second drill section is prevented. A force sensor is provided for sensing the force on the restraining cord. The force on the restraining cord provides an indication of the torque on the connection between the two drill sections. The cord is positioned at a right angle to the longitudinal member such that the longitudinal member coincides with the moment arm utilized in the torque calculations.

In another embodiment of the present invention, the longitudinal member is comprised of a Break-Out Tong and a second winch is provided having a cable attached to the distal end of the Break-Out Tong. A second restraining cord is attached to the distal end of the Make-Up Tong to prevent rotation thereof when the second winch operates to rotate the Break-Out Tong and, consequently, the second drill section. A second force sensor is provided on the second restraining cord to to sense the linear force thereof. In this manner, torque can be calculated from the force on the second restraining cord and the angle between the second restraining cord and the Make-Up Tong.

BRIEF DESCRIPTION OF THE DRAWINGS

For a more complete understanding of the present invention and the advantages thereof, reference is now made to the following description now taken in conjunction with the accompanying Drawings in which.

DETAILED DESCRIPTION OF THE INVENTION

Figure 1:
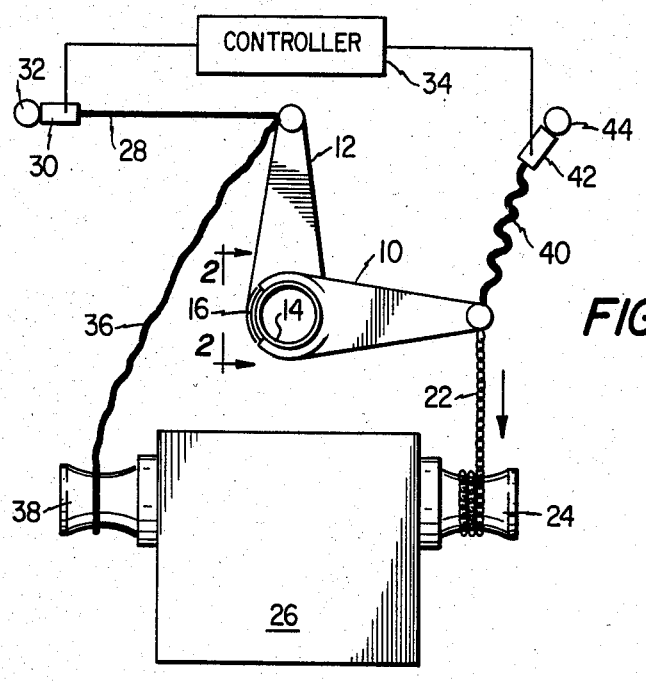
FIG. 1 illustrates a planar diagram of the torque monitoring system of the present invention with the Make-Up Tong applying the torque.
Figure 2:
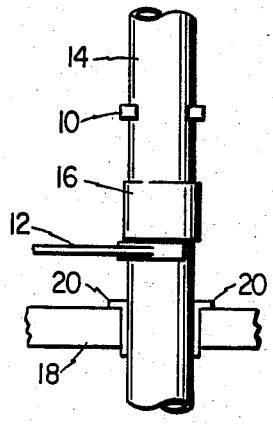
FIG. 2 illustrates a side view of the Tongs and drill sections taken along lines 2—2 of FIG. 1.

Referring now to FIGS. 1 and 2, there is illustrated in FIG. 1 a planar view of a torque monitoring apparatus in accordance with the present invention and FIG. 2 illustrates a side view of the pipe taken along lines 2—2 of FIG. 1. The torque monitoring apparatus includes a Make-Up Tong 10 and a Break-Out Tong 12 for forming the connection between a drill pipe section 14 and the end of a drill string 16. The Make-Up Tong 10 is attached to the drill pipe section 14 and the Break-Out Tong 12 is attached to the end of the drill string 16. The end of the drill string 16 is held in a rotary table 18 with slips 20. The Make-Up Tong 12 is operable to rotate the drill pipe section 14 and the Break-Out Tong 12 is operable to rotate the drill string 16.

A chain 22 has one end thereof connected to the distal end of the Make-Up Tong 10 and the other end thereof wrapped about a winch 24. Retraction of the chain 22 onto the winch 24 results in a clockwise rotation of the Make-Up Tong 10 about the longitudinal axis of the drill pipe section 14. This rotational motion results in tightening of the threaded connection between the drill pipe section 14 and the drill string 16. The winch 24 is connected to a drive system 26 for rotation thereof.

A snub line 28 has one end thereof connected to the distal end of the Break-Out Tong 12 and the other end thereof connected to one end of a load cell 30. The other end of the load cell 30 is connected to a snub post 32. The snub line 28 is operable to restrain movement of the Break Out Tong 12 in the direction of rotation of the Make-Out Tong 10 and the drill pipe section 14, thus restraining movement of the drill string 16 to allow the interconnection to be "torqued up". The load cell-30 is functional to measure the linear force on the snub line 28 as a function of the force supplied to the Make-Up Tong 10 by the winch 24. This force is transferred through the connection between the drill pipe section 14 and drill string 16. The load cell 30 can be of the type manufactured by Eaton Corporation and can have any range from 1000 to 100,000 pounds. As a practical matter, load cells have restricted ranges to supply certain degrees of accuracy for a given output voltage range and, therefore, it is necessary to select the proper range load cell for the particular application. In the preferred embodiment, the load cell 30 is connected to a controller 34 for either indicating the force to the driller or controlling the operation of the drive system 26. The operation of the controller 34 is described in more detail in co-pending Patent Application Ser. No. 525,094 filed on Aug. 22, 1983.

The snub line 28 is disposed at a 90° angle with respect to the center line of the Break-Out Tong 12. To calculate the torque on the connections, it is only necessary to multiply the force on the snub line 28 by the length of the moment arm, the moment arm defined by the perpendicular distance between the force vector of the snub line 28 and the rotational axis of the drill section 14. By maintaining a 90° angular relationship between the snub line 28 and the Break-Out Tong 12, the center line of the Break-Out Tong 12 coincides with the moment arm. Therefore, the force measured by the load cell 30 is directly proportional to the torque.

If the load cell 30 were placed in series with the chain 22, the torque calculation would be a combination of the force applied to the chain 22, the length of the Make-Up Tong 10 and the cosine of the angular deviation of the Make-Up Tong 10 from a perpendicular position with the chain 22. This would result in an error which must be accounted for by the driller. For example, if the Make-Up Tong 10 were 15° off perpendicular, the effective moment arm would be shorter and a 3.4% reduction in torque would result. By applying more force, the driller can account for this but he also must account for the additional change in angular deviation and resulting length of the moment arm. This problem is solved by utilizing the combined Break-Out Tong 12 and snub line 28 which are stationary with respect to rotational movement of the drill pipe section 14.

In addition to maintaining a constant length for the moment arm of the torque calculation, location of the load cell 30 in series with the snub line 28 minimizes damage thereto. When the load cell is located in series with the chain 22, substantial abuse can result. This is due to the fact that the chain is constantly being disconnected and connected to the Make-Up Tong 10 during the drilling of a hole. During disconnection, the chain with the load cell 30 attached thereto is normally laid on the surface of the drilling platform. Due to the expense of load cells, it is desirable to prevent this abuse. Therefore, a distinct advantage is realized by locating the load cell 30 in the protected position in series with the snub line 28.

Figure 3:
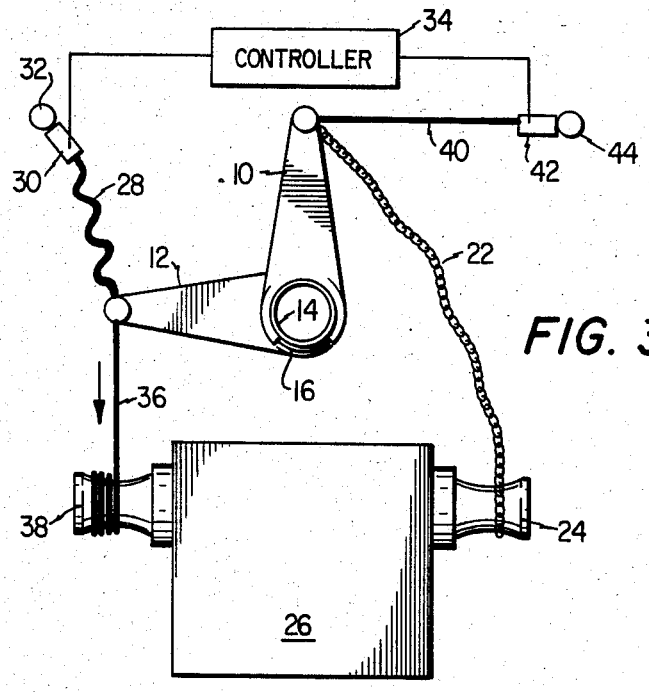
FIG. 3 illustrates a planar view of the torque monitoring apparatus in accordance with the present invention with the Break-Out Tong applying the torque to the connection.

Referring now to FIG. 3, there is illustrated an alternate method for torquing the connection between the drill pipe section 14 and the drill string 16 in accordance with the present invention. Like numerals refer to like parts in the various FIGURES. A cable 36 has one end thereof attached to the distal end of the Break-Out Tong 12 and the other end thereof wrapped about a winch 38. The winch 38 is operable to wind the cable 36 thereabout to rotate the Break-Out Tong 12 and the connected drill string 16 to tighten the connection between the drill string 16 and the drill pipe section 14. To accomplish this, the Break-Out Tong 12 is rotated in the opposite direction to that of the Make-Up Tong 10.

A snub line 40 has one end thereof attached to the distal end of the Make-Up Tong 10 and the other end thereof connected to a load cell 42. The load cell 42 is similar to the load cell 30. The other end of the load cell 42 is attached to a snub post 44. The load cell 42 measures the linear force on the snub line 40 and this is input to the controller 34. During retraction of the cable 36, the snub line 28 which is connected to the Break-Out Tong 12, remains slack and does not supply an opposing force. In addition, the chain 22 is unwrapped from the winch 24 to allow free rotation of the Make-Up Tong 10. The angle between the Make-Up Tong 10 and the snub line 40 when the snub line 40 is taut is approximately 90°, and, as described above with reference to the Break-Out Tong 12 and the snub line 28, this angle is stationary for all positions of the Break-Out Tong 12.

In summary, there has been provided an apparatus for monitoring torque by measuring a linear force applied to a moment arm with respect to the interconnection that is being torqued. During torquing of the connection between two drill pipe sections, a restraining force is applied to the other drill pipe section on a second Tong. The angular position between the direction of the restraining force and the second Tong is maintained constant such that the moment arm for the torque calculations does not vary for all angular positions of the torquing Tong. Therefore, the linear force measured by the load cell is directly proportional to the torque and no adjustment is necessary to determine the actual torque as a function of angular deviations on the torquing Tong.

Although the preferred embodiment has been described in detail, it should be understood that various changes, substitutions and alterations can be made therein without departing from the spirit and scope of the invention as defined by the appended claims.

What is claimed is:

1. An apparatus for torquing a threaded connection between first and second drill sections, comprising:

a Make-Up Tong attached to the first drill section proximate the connection for rotation thereof;

a winch;

a cable having one end thereof wrapped about said winch for retraction thereof, the other end of said cable attached to the distal end of said Make-Up Tong;

a Break-Out Tong attached to the second drill section perpendicular to the longitudinal axis thereof;

a snub line having one end thereof attached proximate the distal end of said Break-Out Tong;

a transducer for measuring linear force, said transducer attached between the other end of said snub line and an anchor point such that said snub line restrains rotational movement of the second drill section to allow tightening of the connection, the linear force measured by said transducer utilized to calculate the torque on the connection;

said snub line oriented at essentially a 90° angle with respect to said Break-Out Tong, the angle stationary for rotation of the first drill section such that the calculation of torque therefrom is independent of variations in the length of the moment arm;

a second winch;

a second cable having one end thereof wrapped about said second winch for retraction thereof, the other end of said second cable attached to the distal end of said Break-Out Tong;

a second snub line having one end thereof attached proximate the distal end of said Make-Up Tong; and a second transducer for measuring linear force, said second transducer attached between the other end of said second snub line and a second anchor point such that said second snub line restrains rotational movement of the first drill section to allow tightening of the connection by rotation of the second drill section through retraction of said second cable;

said second snub line oriented at essentially a 90° angle with respect to said Make-Up Tong.

2. The apparatus of claim 1 wherein said transducer comprises a load cell.

3. An apparatus for torquing a threaded connection between first and second drill sections, comprising:

a Make-Up Tong for attachment for the first drill section proximate the connection for rotation thereof;

a Break-Out Tong for attachment to the second drill section proximate the connection for rotation thereof;

a first winch having a cable wrapped thereabout with the other end attached to the distal end of said Make-Up Tong such that retraction of the cable rotates the first drill section;

a second winch having a cable wrapped thereabout, the free end of the cable attached to the distal end of said Break-Out Tong such that retraction of the cable rotates the second drill section to tighten the connection;

a first snub line havine one end thereof attached proximate the distal end of said Break-Out Tong;

a first transducer for measuring linear force, said first transducer attached between the other end of said first snub line and a first anchor point such that said first snub line restrains rotational movement of the second drill section with respect to the first drill section;

a second snub line having one end thereof attached proximate the distal end of said Make-Up Tong;

a second transducer for measuring linear force, said second transducer attached between the other end of said second snub line and a second anchor point such that said second snub line restrains rotational movement of the first drill section to allow tightening of the connection by said Break-Out Tong and said second winch; and said first and second snub lines oriented at an essentially 90° angle with respect to the respective one of said Make-Up and Break-Out Tongs, the respective angle stationary for rotation of the other of the first and second drill sections such that forces measured by said first and second transducers can be utilized in calculations of torque therefrom and the torque calculations are independent of variations in the length of the moment arm.

* * * * *

UNITED STATES PATENT AND TRADEMARK OFFICE

CERTIFICATE OF CORRECTION

PATENT NO. : 4,567,779

DATED : February 4, 1986

INVENTOR(S) : Paul Byrne

It is certified that error appears in the above-identified patent and that said Letters Patent is hereby corrected as shown below:

Col. 6, line 10, "for attachment for" should be --for attachment to--;

line 25, "havine" should be --having--.

Signed and Sealed this

*Twenty-seventh* Day of *May 1986*

[SEAL]

*Attest:*

DONALD J. QUIGG

*Attesting Officer*

*Commissioner of Patents and Trademarks*